US006959849B2

(12) United States Patent
Burdenko

(10) Patent No.: US 6,959,849 B2
(45) Date of Patent: Nov. 1, 2005

(54) DRIVE ROLLER ASSEMBLY

(75) Inventor: Michael N. Burdenko, Wellesley, MA (US)

(73) Assignee: Polaroid Corporation, Waltham, MA (US)

( * ) Notice: Subject to any disclaimer, the term of this patent is extended or adjusted under 35 U.S.C. 154(b) by 0 days.

(21) Appl. No.: 10/743,588

(22) Filed: Dec. 22, 2003

(65) Prior Publication Data

US 2004/0134958 A1 Jul. 15, 2004

Related U.S. Application Data

(60) Provisional application No. 60/436,209, filed on Dec. 23, 2002.

(51) Int. Cl.[7] ..... B65H 20/00

(52) U.S. Cl. ..... 226/181; 226/182; 226/183; 226/185; 226/187; 226/193

(58) Field of Search ..... 226/181, 182, 226/183, 185, 186, 187, 193

(56) References Cited

U.S. PATENT DOCUMENTS

| | | | | |
|---|---|---|---|---|
| 1,773,933 A | | 8/1930 | Barr | |
| 4,720,714 A | * | 1/1988 | Yukio | 346/134 |
| 4,932,577 A | * | 6/1990 | Weiss | 226/101 |
| 5,070,365 A | | 12/1991 | Agarwal | 355/212 |
| 5,158,380 A | | 10/1992 | Hauslaib et al. | 400/605 |
| 5,819,140 A | | 10/1998 | Iseki et al. | 399/165 |
| 6,250,220 B1 | | 6/2001 | Sainio et al. | 101/228 |

FOREIGN PATENT DOCUMENTS

| | | | |
|---|---|---|---|
| DE | 295 22 340 | 3/2002 | B65H/23/025 |
| WO | WO 99/62804 | 12/1999 | B65H/27/00 |

* cited by examiner

*Primary Examiner*—Kathy Matecki
*Assistant Examiner*—Evan Langdon

(57) ABSTRACT

There are described drive roller assemblies for pulling print media within, or in conjunction with, a printing apparatus. In one embodiment the assembly includes a rigid drive roller having a hard outer surface in conjunction with a pressure roller having a deformable surface. In another embodiment the assembly has a rigid drive roller in conjunction with a plurality of pressure rollers which are adapted for pressing print media against the drive roller over substantially different portions of the drive roller length.

7 Claims, 4 Drawing Sheets

DRIVE ROLLER ASSEMBLY

REFERENCE TO RELATED APPLICATIONS

This application claims the benefit of provisional application Ser. No. 60/436,209, filed Dec. 23, 2002.

TECHNICAL FIELD

The present disclosure relates to drive or pull rollers typically used for pulling print media within, or in conjunction with, a printing apparatus.

BACKGROUND OF THE INVENTION

Drive roller assemblies are required to create sufficient force for pulling print media and to distribute that force evenly across the width of the media. Problems which can occur include the bending of rollers used over extended widths of print media and the unequal forces applied at different points across these extended widths as a result of such bending. Whereas hard rollers may be constructed to avoid bending over the significant lengths required, creating sufficient force for pulling typically also requires a pressure roller having a deformable surface. The problem of roller bending occurs in such pressure rollers due to their being pressed against the drive roller. Thus, it is typically advantageous to improve the frictional force created by drive rollers and to provide an even distribution of such force across the width of the print media.

SUMMARY OF THE INVENTION

The present invention relates to a drive roller assembly for pulling print media within, or in conjunction with, a printing apparatus. One form of the drive roller assembly of the invention includes a rigid drive roller having a hard outer surface. This rigid drive roller works in conjunction with a pressure roller having a deformable surface, such as rubber, which surface is used for pressing (or nipping) the print media against the hard surface of the drive roller.

In one embodiment, the drive roller is defined by a length and a second pressure roller is employed in conjunction with the first mentioned pressure roller. The two pressure rollers are adapted for pressing print media against the hard surface along substantially different portions of the drive roller length. The two pressure rollers may be arranged to collectively contact the hard outer surface over the entire length of the drive roller and may be mounted in line or at different but adjacent radial positions with respect to the drive roller.

Another form of drive roller assembly is disclosed herein which includes a rigid drive roller having a length and a plurality of pressure rollers adapted for pressing print media against the drive roller over substantially different portions of the drive roller length. Each of these pressure rollers may be mounted at a different radial position with respect to the drive roller, and these different radial positions may be adjacent to each other. The pressure rollers may be mounted in line or they may overlap in the direction of print media travel.

BRIEF DESCRIPTION OF THE DRAWINGS

For a better understanding of the invention as well as other features thereof, reference is made to the following detailed description of various preferred embodiments thereof taken in conjunction with the accompanying drawings wherein.

DESCRIPTION OF THE PREFERRED EMBODIMENTS

Figure 1:
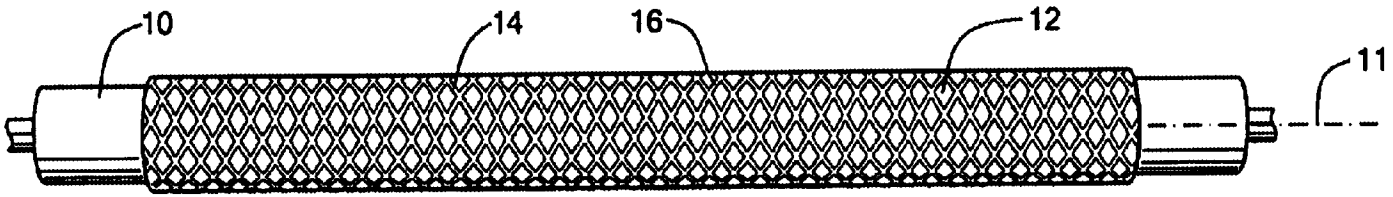
FIG. 1 is a representational cross sectional side view of a drive roller.

FIG. 1 shows a drive roller 10 including a central axis of rotation 11 and a hard outer surface 12. The opposite directions of axis 11 may also be thought of as opposing axial directions, or opposing directions of helical rotation. A coating may also be provided to outer surface 12 to increase friction when the roller is in contact with a sheet or a web of a print material. Although the roller 10 is illustrated with grooves 14, 16 in the surface 12, the surface can be smooth or fabricated with desired roughened features.

Figure 2:
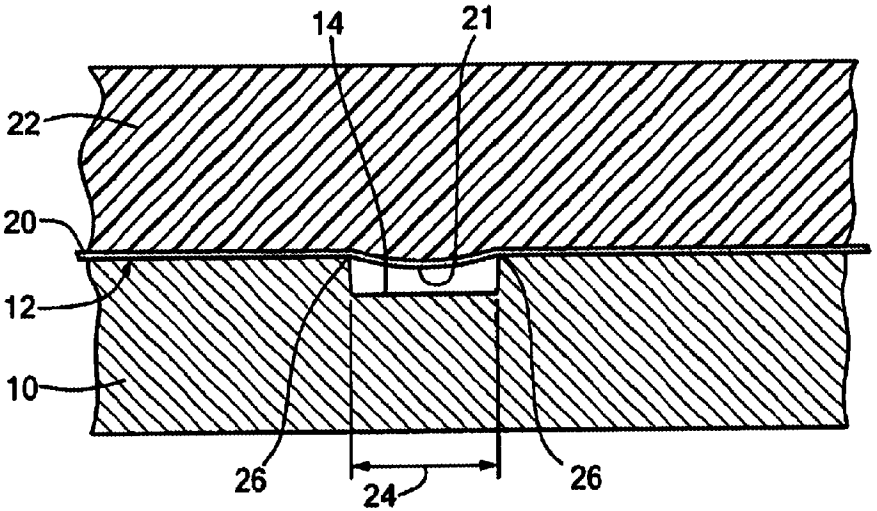
FIG. 2 is a representational cross sectional side view of a portion of the drive roller of FIG. 1.

FIG. 2 is a representational cross-section of one of the grooves 14 formed on the surface 12 of drive roller 10. A layer of print media 20 is shown along surface 12 and passing over groove 14, and a portion of pressure roller 22 is shown pressing (or nipping) said print media against said outer surface 12. The linear width 24 of groove 14 along axis 11 is shown to have a portion 21 of print media 20 bulging into the groove 14, which bulging is caused by the deformable nature of pressure roller 22. This bulging creates sheer forces where the ridges 26 of groove 14 are pressed against print media 20. Optimization of the pulling force created by drive roller 10 involves determining the width 24 of grooves 14, 16 (FIG. 1) to optimize the bulging of print media as described and the sheer forces created thereby against the loss of frictional surface represented by the width 24 of grooves 14, 16.

Figure 3:
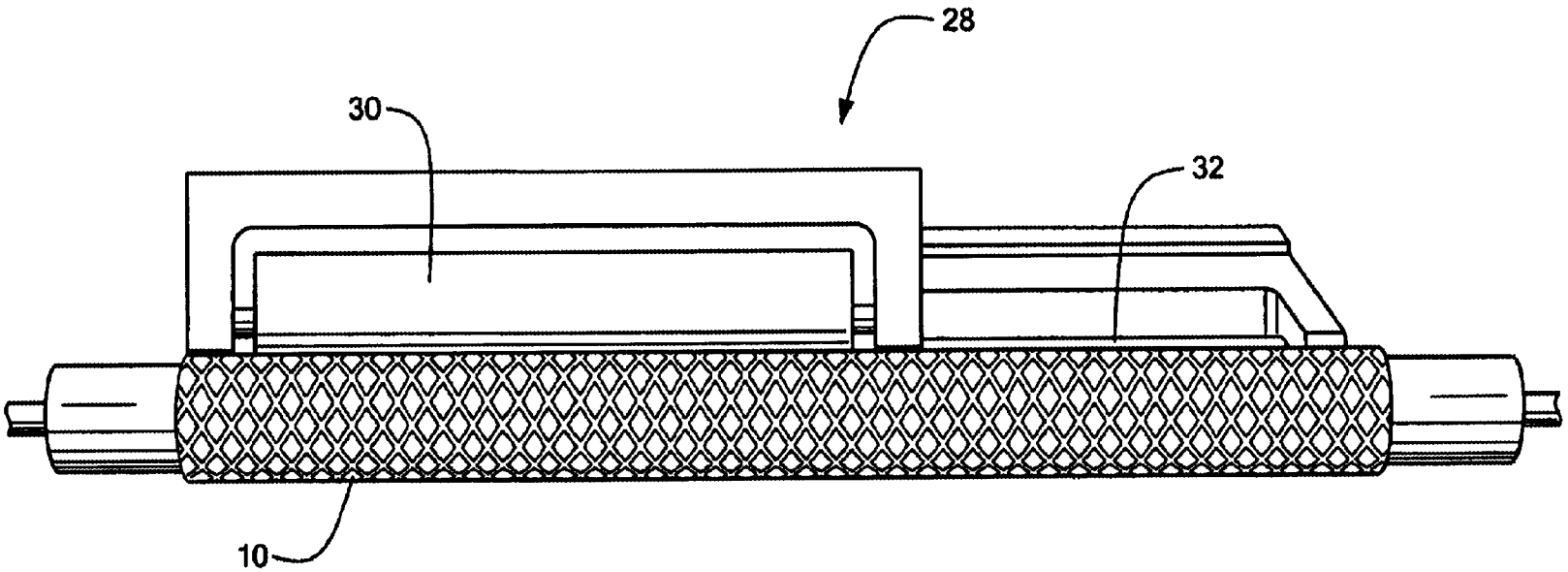
FIG. 3 is a representational cross sectional side view of a pair of pressure rollers arranged in conjunction with a single drive roller.
Figure 4:
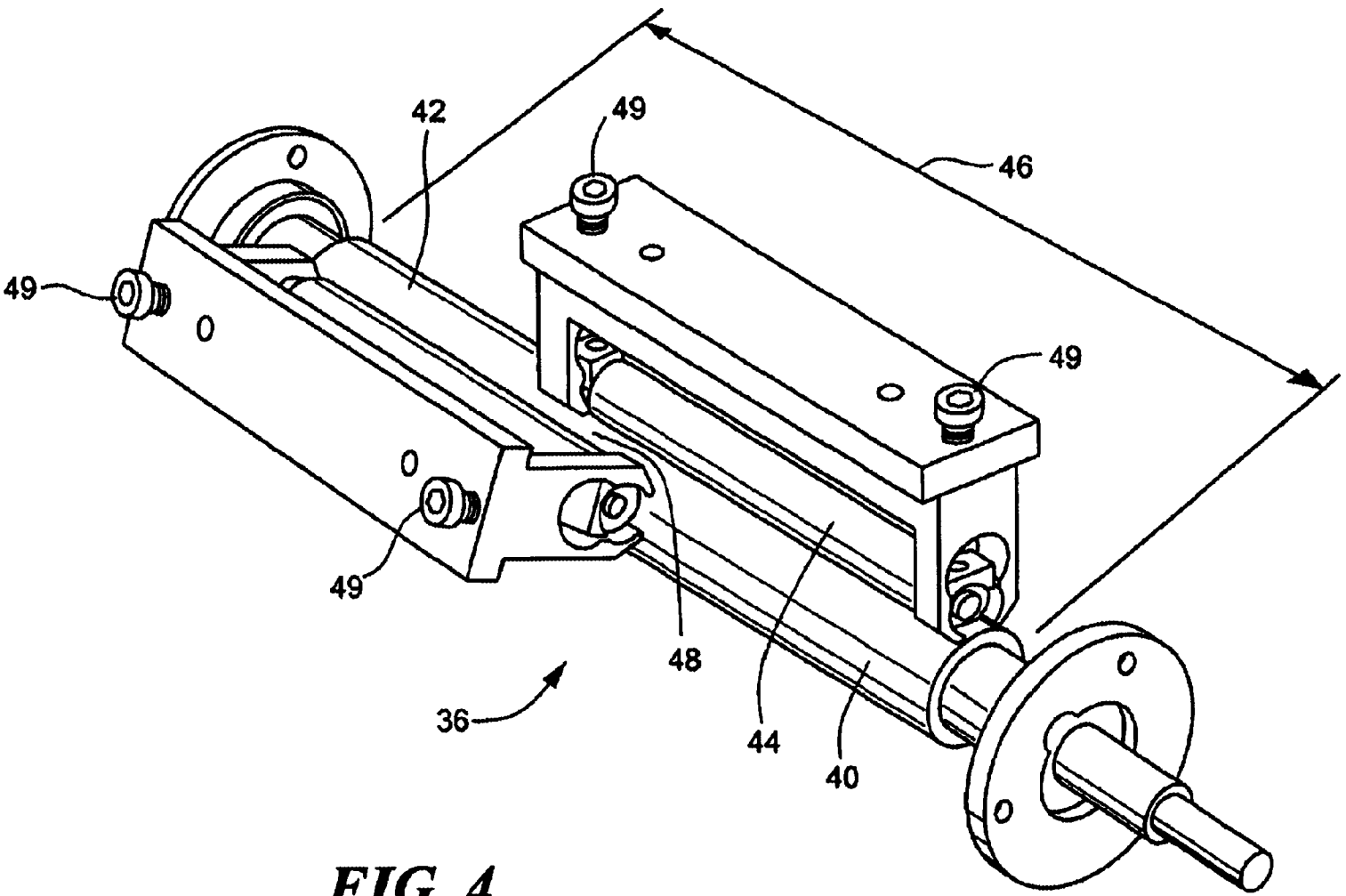
FIG. 4 is a representational perspective view of another drive roller assembly according to the invention.
Figure 5:
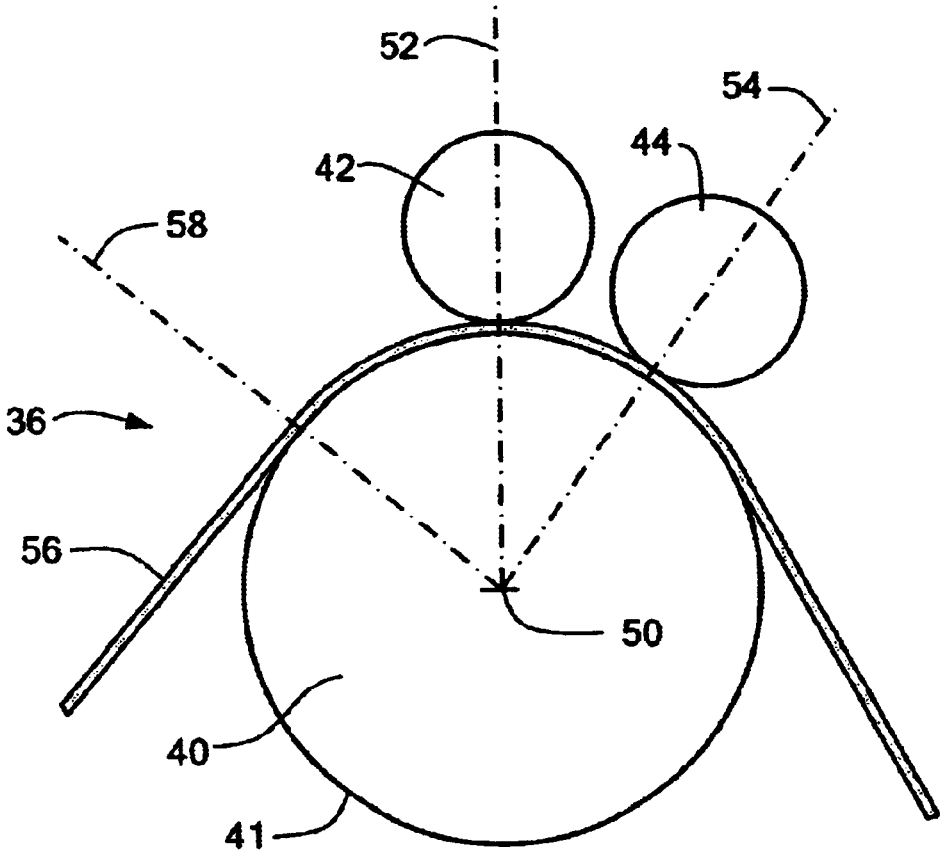
FIG. 5 is a representational end view of the drive roller assembly of FIG. 4.

FIG. 3 illustrates a drive roller assembly 28 showing drive roller 10 (FIG. 1) used in conjunction with a pair of pressure rollers 30, 32. FIG. 4 is a perspective drawing of another drive roller assembly 36, which is similar to the assembly 28 (FIG. 3). FIG. 4 is intended to be a representation of FIG. 3, except for the helical grooves present in drive roller 10. FIG. 5 shows a representational end view of drive roller assembly 36 being used for pulling print media 56.

Drive roller assembly 36 includes drive roller 40 and pressure rollers 42, 44. Pressure rollers 42, 44 are located to press print media 56 against drive roller 40, individually over substantially different portions of the length 46 (FIG. 4) of drive roller 40, and collectively over the entire length 46. For this purpose, pressure rollers 42, 44 are mounted at different radial positions 52, 54 (FIG. 5), respectively, with respect to the axis 50 of roller 40 (FIG. 5). These different radial positions 52, 54 are preferably adjacent to each other and typically as close as the physical size of pressure rollers 42, 44 will allow. FIG. 4 also shows some overlap between the contacts of pressure rollers 42, 44 in the central area 48, which overlap can be used to increase the contact or nip width beyond the overall length 46.

The maximum frictional force created on print media 56 by each pressure roller 42, 44 is related to the distance along the surface 41 that print media 56 contacts drive roller 40. Thus the maximum force that pressure roller 44 can create is greater than the maximum frictional force that pressure roller 42 can create because print media 56 contacts drive roller 40 from radial position 54 to radial position 58 for pressure roller 44 and only between radial positions 52 and 58 for pressure roller 42. The amount of friction created on print media 56 is also affected by the amount of pressure applied by pressure rollers 42, 44. FIG. 4 shows pressure adjustment screws 49 located at each end of each pressure roller 42, 44, which screws 49 may be used to vary the pressure of rollers 42, 44 by any suitable mechanism, such as a spring bias. Thus the nip pressure created by rollers 42, 44 may be adjusted to equalize the friction created across length 46 in spite of the unequal wrap lengths. In the case of overlap area 48, the individual adjustment screws 49 in the overlap area may be set reduce the individual pressures and thereby compensate for the overlap. Alternatively, and second pressure roller may be moved to a non-parallel position to the drive roller.

Although the invention has been described in detail with respect to various preferred embodiments thereof, it will be recognized by those skilled in the art that the invention is not limited thereto but rather that variations and modifications can be made therein which are within the spirit of the invention and the scope of the amended claims.

What is claimed is:

1. A drive roller assembly for pulling print media, comprising:

a rigid drive roller having a first length; and a plurality of pressure rollers adapted for pressing print media against said drive roller over substantially different portions of said first length, each of said plurality of pressure rollers having a length which is less than said first length and wherein the pressure applied to said drive roller by each of said pressure rollers can be adjusted independently of the others, and wherein at least one of said plurality of pressure rollers is arranged to overlap in length one next adjacent pressure roller along the length of said drive roller.

2. The drive roller assembly of claim 1, wherein each of said plurality of pressure rollers is mounted at a different radial position with respect to the axis of rotation of said drive roller.

3. The drive roller assembly of claim 2, wherein said different radial positions of said pressure rollers are adjacent to each other.

4. The drive roller assembly of claim 1 wherein said rigid drive roller has a hard outer surface including a plurality of helical grooves formed in said outer surface in each helical direction of rotation.

5. The drive roller assembly of claim 1 wherein said plurality of pressure rollers include first and second pressure rollers, wherein the maximum frictional force that can be created on the surface of said drive roller by said first pressure roller is greater than the maximum frictional force that can be created on the surface of said drive roller by said second pressure roller.

6. The drive roller assembly of claim 1 having first and second pressure rollers, wherein said first and second pressure rollers are arranged to overlap in length along the length of said drive roller.

7. The drive roller assembly of claim 1 wherein the axis of rotation of one of said pressure rollers as not parallel to the axis of rotation of said drive roller.

* * * * *